US010435961B2

(12) United States Patent
Estrada et al.

(10) Patent No.: US 10,435,961 B2
(45) Date of Patent: Oct. 8, 2019

(54) SECURING MECHANISM FOR ROTARY ASSEMBLY WEAR SLEEVES

(71) Applicant: Halliburton Energy Services, Inc., Houston, TX (US)

(72) Inventors: Edgar Andres Estrada, Edmonton (CA); Mesfin Ayale Demissie, Edmonton (CA); Alben D'Silva, Edmonton (CA)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 130 days.

(21) Appl. No.: 15/517,883

(22) PCT Filed: Dec. 23, 2014

(86) PCT No.: PCT/US2014/072096

§ 371 (c)(1),
(2) Date: Apr. 7, 2017

(87) PCT Pub. No.: WO2016/105379

PCT Pub. Date: Jun. 30, 2016

(65) Prior Publication Data

US 2017/0247956 A1 Aug. 31, 2017

(51) Int. Cl.
*E21B 17/12* (2006.01)
*E21B 17/10* (2006.01)
(Continued)

(52) U.S. Cl.
CPC ..... *E21B 17/12* (2013.01); *E21B 7/04* (2013.01); *E21B 7/062* (2013.01); *E21B 17/10* (2013.01); *E21B 17/1085* (2013.01)

(58) Field of Classification Search
CPC ..... E21B 17/10; E21B 17/1085; E21B 17/12; E21B 7/04; E21B 7/062
See application file for complete search history.

(56) References Cited

U.S. PATENT DOCUMENTS 2,333,847 A * 11/1943 Deely ..... E21B 3/04 166/86.2
3,912,425 A 10/1975 Tschirky et al.
(Continued)

OTHER PUBLICATIONS

International Search Report and Written Opinion issued in corresponding application No. PCT/US2014/072096 dated Sep. 1, 2015, 17 pgs.

*Primary Examiner* — Caroline N Butcher
(74) *Attorney, Agent, or Firm* — Chamberlain Hrdlicka

(57) ABSTRACT

A method and apparatus are provided for securing a protective sleeve or wear sleeve to a rotary component which is rotatable relative to a rotary seal, such that the wear sleeve is in relatively rotating sealing engagement with the rotary seal. The wear sleeve is secured to the shaft by wedging a lock ring between the wear sleeve and the shaft. Wedging action of the lock ring can be effected by wedging formations, such as tapered surfaces, configured for causing wedging of the lock ring in response to operator-induced axial movement of the lock ring relative to the shaft and/or the wear sleeve. Wedging of the lock ring can be effected by cooperating screw threads on the lock ring and the wear sleeve, so that an operator can tighten the sleeve on the shaft by application of torque thereto.

18 Claims, 7 Drawing Sheets

(51) Int. Cl.
*E21B 7/06* (2006.01)
*E21B 7/04* (2006.01)

(56) References Cited

U.S. PATENT DOCUMENTS

| | | | | |
|---|---|---|---|---|
| 3,941,141 | A | 3/1976 | Robert | |
| 4,044,829 | A * | 8/1977 | Jessup | E21B 34/102 166/264 |
| 4,372,563 | A * | 2/1983 | Diehl | E21B 33/03 166/124 |
| 4,534,585 | A * | 8/1985 | Saliger | E21B 17/043 285/288.5 |
| 6,786,557 | B2 | 9/2004 | Montgomery | |
| 7,255,163 | B2 | 8/2007 | Rivard | |
| 7,503,390 | B2 | 3/2009 | Gomez | |
| 7,624,799 | B2 | 12/2009 | Myhre et al. | |
| 7,979,986 | B2 | 7/2011 | Simmons et al. | |
| 8,522,877 | B2 | 9/2013 | Chambers et al. | |
| 2011/0095485 | A1 | 4/2011 | Saylor, III et al. | |

* cited by examiner

SECURING MECHANISM FOR ROTARY ASSEMBLY WEAR SLEEVES

BACKGROUND

Rotary well tools and other driven rotary mechanisms often comprise relatively rotating components which are sealingly engaged with one another at a radial interface between the components. Some rotary assemblies, for example, comprise a driven shaft received in a non-rotating housing assembly (such as, for example, a co-axial tubular housing or sleeve forming part of a drill string), allowing rotation of the driveshaft relative to the housing assembly to which it is secured. In some rotary assemblies, however, a rotatable sleeve or housing seemingly receives a co-axial non-rotating shaft or mandrel.

Examples of sealed rotary assemblies include rotary steering tools connected in-line in the drill string and providing a housing sleeve that non-rotatably engages a borehole wall for steering purposes, while allowing sealed rotation of a tubular driveshaft passing therethrough. To protect the driveshaft from wear at the rotary seal interface, a removable and replaceable wear sleeve is often mounted on the driveshaft, being radially sandwiched between the rotary seal and the driveshaft. A radially outer wear surface of the wear sleeve is thus exposed to rotating sealing contact with the rotary seal.

Relative movement between the wear sleeve and the shaft is undesirable. Relative rotational movement can be caused by friction exerted by the rotary seal on the sleeve. Such rotational movement of the sleeve on the shaft would inevitably lead to failure of seals between the shaft and the sleeve, which are designed for static sealing.

Radial movement of the sleeve on the shaft can cause eccentric forces to be placed on the rotary seal, which would detrimentally affect seal life. Axial movement of the sleeve can lead to fretting issues of not only the primary rotary seal, but also of seals between the wear sleeve and the shaft.

BRIEF DESCRIPTION OF THE DRAWINGS

Some embodiments are illustrated by way of example and not limitation in the figures of the accompanying drawings in which.

DETAILED DESCRIPTION

One embodiment of the disclosure comprises a method and apparatus for securing a protective sleeve to a shaft which is rotatable relative to a rotary seal by wedging a lock ring between the protective sleeve and the shaft.

Wedging action of the lock ring may be effected by wedging formations configured for causing wedging of the lock ring in response to operator-induced axial movement of the lock ring relative to the shaft and/or protective sleeve. In some embodiments, the wedging formations may comprise tapered surfaces defined respectively on a radially outer periphery of the shaft and on a radially inner periphery of the lock ring. The tapered surfaces may in some embodiments be flat, inclined surfaces. In other embodiments, the tapered surfaces may be part-conical, having a consistent circumferentially extending incline.

The lock ring and the wear sleeve may have cooperating screw threads co-axial with the shaft and being configured to serve as a mechanical advantage means for translating operator-applied relative rotation between the protective sleeve and the shaft to axial travel, with mechanical advantage, of the lock ring relative to a socket. In some embodiments, the wedging formation may be provided by complementary tapering screw threads on the outer radius of the lock ring and in your radius of a socket formation forming part of the wear sleeve, respectively.

The following detailed description describes example embodiments of the disclosure with reference to the accompanying drawings, which depict various details of examples that show how various aspects of the disclosure may be practiced. The discussion addresses various examples of novel methods, systems, devices and apparatuses in reference to these drawings, and describes the depicted embodiments in sufficient detail to enable those skilled in the art to practice the disclosed subject matter. Many embodiments other than the illustrative examples discussed herein may be used to practice these techniques. Structural and operational changes in addition to the alternatives specifically discussed herein may be made without departing from the scope of this disclosure.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

Figure 1:
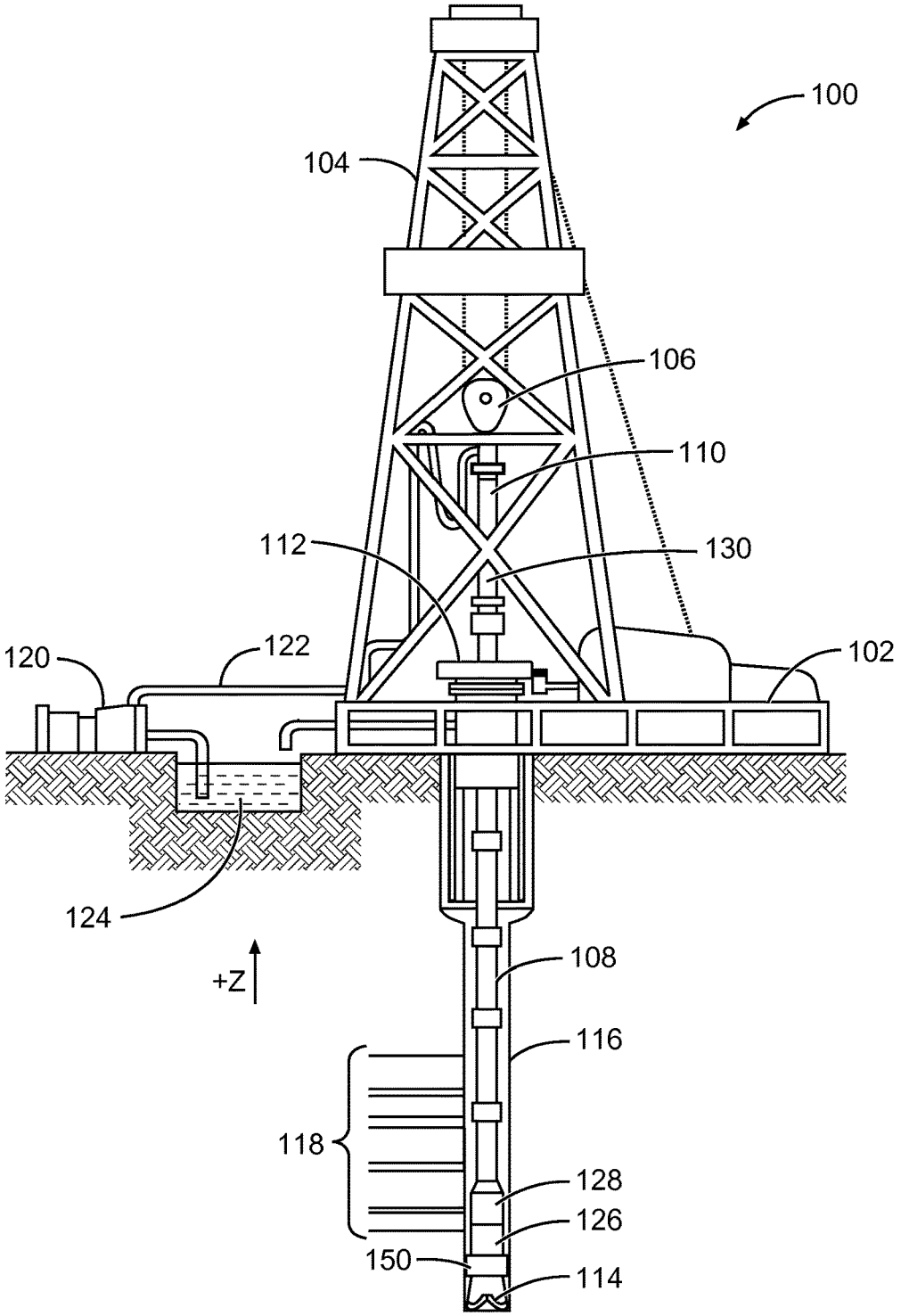
FIG. 1 depicts a schematic elevational diagram of a drilling installation including a drill string having incorporated therein a steering tool that comprises a sealed rotary assembly, in accordance with an example embodiment.

FIG. 1 is a schematic view of an example drilling installation 100 that includes an example well tool that includes a rotary assembly with a wear sleeve securing mechanism according to an example embodiment. The drilling installation 100 includes a drilling platform 102 equipped with a derrick 104 that supports a hoist 106 for raising and lowering a drill string 108 comprising jointed sections of drill pipe. The hoist 106 suspends a top drive 110 suitable for rotating the drill string 108 and lowering the drill string 108 through the well head 112. Connected to the lower end of the drill string 108 is a drill bit 114. As the drill bit 114 rotates, it creates a borehole 116 that passes through various formations 118. A pump 120 circulates drilling fluid through a supply pipe 122 to top drive 110, down through the interior of drill string 108, through orifices in drill bit 114, back to the surface via an annulus around drill string 108, and into a retention pit 124. The drilling fluid transports cuttings from the borehole 116 into the pit 124 and aids in maintaining the integrity of the borehole 116. Various materials can be used for drilling fluid, including a salt-water based conductive mud.

An assembly of drilling tools 126, 128 is in this example embodiment integrated into a bottom-hole assembly (BHA) near the bit 114.

The BHA in this example embodiment is configured to allow surface-controlled steering of the drill bit 114 by means of a steering assembly 150 incorporated in the drill string 108 and forming part of the BHA. The steering assembly 150 is a well tool comprising a sealed rotary assembly that, as will be described in greater detail in what follows, comprises a steering sleeve configured for non-rotary engagement with the borehole's wall while the drill string 108 extends therethrough is drivingly rotated.

Note that the steering assembly 150 as described below is only one example embodiment of the disclosure, and that features particular to the described application of the disclosure may be varied in other applications. The steering assembly 150, for example, comprises a drivingly rotatable component received approximately co-axially in a non-rotating steering sleeve. The disclosure applies, however, to the provision of a rotary sealing interface between any relatively rotating parts. In other embodiments, for example, a radially internal component may be non-rotating, while a receiving component (such as a housing or sleeve which envelops the stationary internal component) maybe rotatable. In yet further embodiments, both components may be rotatable, but at different speeds and/or in different directions. The following description should therefore be read with the understanding that the described techniques can be applied to any application in which rotary sealing engagement is to be provided between relatively rotating components of a rotary assembly.

As used herein, "axial" and "longitudinal" refer to any rectilinear direction at least approximately parallel a rotational axis of a rotary component with which non-rotary components of a rotary assembly under discussion are sealingly engaged (for clarity of description being referred to hereafter simply as "the rotary axis"); "radial" refers to directions extending at least approximately along any straight line that intersects the rotary axis and lies in a plane transverse to the rotary axis; "tangential" refers to directions extending at least approximately along any straight line that does not intersect the rotary axis and that lies in a plane transverse to the rotary axis; and "circumferential" or "rotational" refers to any curve line that extends at least approximately along an arcuate or circular path described by angular movement about the rotary axis of a point having a fixed radial spacing from the rotary axis during the annular movement. "Rotation" and its derivatives mean not only continuous or repeated rotation through 360° or more, but also includes angular or circumferential displacement of less than a full revolution.

As used herein, "forwards" and "downhole" (together with their derivatives) refer to axial movement or relative axial location closer to the drill bit 114, away from the surface. Conversely, "backwards," "rearwards," and "uphole" (together with their derivatives) refer to axial movement or relative axial location closer to the surface, away from the drill bit 114. Note that in each of FIGS. 2, 3, 4, 7, and 8, the respective views depicted such that the downhole direction extends from left to right.

Figure 2:
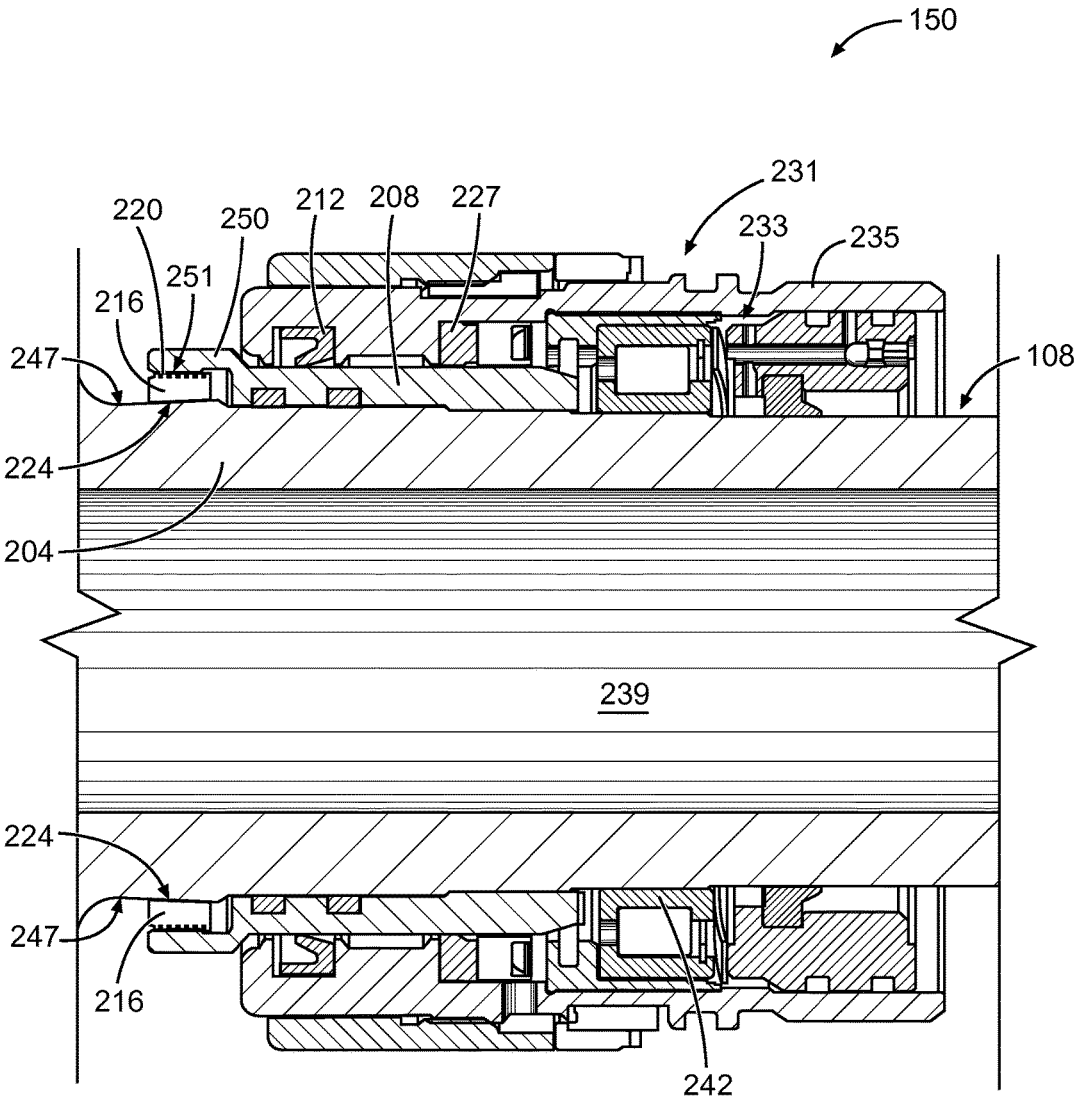
FIG. 2 depicts a schematic axial section of a rotary assembly for a well tool in accordance with an example embodiment similar or analogous to that of FIG. 1.

FIG. 2 shows part of the steering assembly 150 integrated in the drill string 108 for line operator-controlled steering of the drill bit 114. The steering assembly 150 includes a non-rotary housing assembly that comprises a housing sleeve 235 which is broadly hollow cylindrical in shape and is co-axially mounted on a tubular drive shaft 204 so as to permit relative rotation between the shaft 204 and the housing sleeve 235. Although only a part of the axially extending length of the shaft 204 is shown in FIG. 2, it is to be noted that the shaft 204 is connected in-line in the drill string 108 to transmit torque and rotation from one end of the shaft 204 to the other. The 235, on the other hand, is configured for forced contact, when deployed downhole, with a cylindrical wall of the borehole 116 such that rotation of the housing sleeve 235 with the shaft 204 is resisted or prevented by engagement of the borehole wall by the housing assembly which the housing sleeve 235 forms part. Again, note that other embodiments may comprise a rotatable, torque-transmitting housing surrounding a non-rotating shaft.

When the housing sleeve 235 is thus locked in a rotationally static condition, the driven shaft 204 rotates freely within the housing sleeve 235 by operation of a bearing assembly that is co-axially housed within the housing sleeve 235, with the shaft 204 being journaled co-axially through a roller bearing 242 that forms part of the bearing assembly.

The bearing 242 is located in a sealed annular housing cavity 233 defined radially between the shaft 204 and the housing sleeve 235. The housing cavity 233 is in this example embodiment filled with fluid lubricant (for example, oil) that lubricates the bearing 242.

When located downhole, the steering assembly 150 is exposed to ambient drilling fluid located in the borehole annulus. To prevent ingress of drilling fluid materials into the housing cavity 233, particularly considering that ambient drilling fluid pressures can be significantly greater than fluid pressure in the housing cavity 233, the steering assembly 150 comprises a number of sealing devices that sealingly isolate the housing cavity 233 from the exterior of the steering assembly 150.

In this example embodiment, a mounting arrangement of the bearing 242, which is located adjacent a downhole end of the housing cavity 233, serves to seal the housing cavity 233 against ingress of foreign material by axial migration in an uphole direction. Note that the particular orientation of the rotary assembly as described here is arbitrary or dictated by design considerations particular to this example embodiment, and that in other embodiments or in other instances within the drill string 108, the orientation of the relevant components of the rotary assembly may be inverted. In embodiments other than downhole drill tools, no uphole or downhole orientation will, of course, apply. Note that an inner race of the bearing 242 is tightly fitted on the shaft 204 for rotation therewith. The bearing assembly therefore provides at least one rotationally static seal interface with a radially outer surface of the shaft 204.

At the opposite of an upper end of the housing cavity 233, however, a rotary seal arrangement (e.g., sealing contact between relatively rotating components) seals off the housing cavity 233, to prevent ingress of foreign material into the housing cavity 233 by migration thereof axially in a downhole direction, and/or to prevent escape of housing cavity 233 by axial migration thereof in an uphole direction. One such rotary sealing interface is provided by a main rotary seal 227 comprising an annular element that is co-axially housed within the housing sleeve 235 and is secured to the housing sleeve 235 to prevent rotation relative thereto. The rotary assembly in this example embodiment further includes a barrier seal 212 located axially uphole of the main seal 227. The barrier seal 212 consists of an annular sealing member mounted co-axially in the housing sleeve 235 in a manner similar to the main seal 227, being rotationally secured to the housing sleeve 235.

Rotary sealing interfaces such as those at the barrier seal 212 and the main seal 227 tend to cause wear on a radially outer surface with which they are in firm sealing contact, due to continuous rotation of the rotating surface relative to the rotary seal 212, 227. To protect the shaft 204 against the development of potential structural weaknesses caused by rotary seal wear (particularly considering the critical importance of structural integrity of torque-transmitting components such as the shaft 204), and because removal and replacement of the shaft 204 in the steering assembly 150 can be problematic, a protective covering in the example form of a wear sleeve 208 is removably and replaceably mounted on the sleeve, being radially sandwiched between the shaft 204 is and the rotary seals 212, 227. The wear sleeve 208 is less expensive than the shaft 204 and is thus provided to absorb rotary seal wear to which the shaft 204 would otherwise be exposed. The mounting mechanism of the wear sleeve 208 is further configured to promote ready removal and replacement of the wear sleeve 208, when compared to the more elaborate procedure required for removal and replacement of the shaft 204. Again, bear in mind that the drivingly rotated component may in other embodiments be an assembly part similar or analogous to the housing sleeve 235.

The wear sleeve 208 is a generally tubular component located co-axially on the shaft 204 such that a main portion of the wear sleeve 208 lines the radially outer surface of the shaft 204 for an axially extending portion of the length of the shaft 204, a radially inner surface of the shaft 204's main portion being in sealing contact with the outer surface of the shaft 204. A radially outer surface of the wear sleeve 208 in the covered portion defining a wear surface which is in circumferential sealing contact with the main seal 227 (and, in this example, with the barrier seal 212). The wear sleeve 208 thus effectively spaces the circular line of seal contact radially from the radially outer surface of the shaft 204, protecting the shaft 204 from rotary seal wear. As will be described further below, the wear sleeve 208 is mounted on the shaft 204 to facilitate removal of the wear sleeve 208 after a period of use, and replacement thereof by a fresh wear sleeve 208.

The steering assembly 150 in this example embodiment comprises a securing mechanism for securing the wear sleeve 208 to shaft 204 such that the wear sleeve 208 is anchored to the shaft 204 for axial, radial, and rotational movement therewith. The securing mechanism includes a lock ring 216 configured for wedging insertion axially between the shaft 204 and part of the wear sleeve 208, to secure together the wear sleeve 208 and the shaft 204 by wedging action. For this purpose, the wear sleeve 208 in this example embodiment has at its uphole end a socket formation comprising a radially widened mouth portion having a cylindrical radially inner periphery which is radially spaced from the shaft 204 and on which an internal screw-thread 220 is provided co-axially with the rotary axis of the shaft 204. A generally annular socket 251 is thus defined between the shaft and the wear sleeve 208, the socket opening towards and being accessible from the uphole end of the wear sleeve 208.

The socket 251 is complementary in shape to the lock ring 216, to permit insertion of the lock ring 216 into the socket 251 by axial movement thereof in the downhole direction. The lock ring 216 in this example embodiment has an internal screw thread 220 complementary to that of the wear sleeve 208 (both of which are, for clarity of description, indicated in the drawings by numeral 220.) Note that the pair of complementary screw threads 220 in this example provides a tightening mechanism for translating a tightening rotation and torque applied by an operator to the wear sleeve 208, for example, to axial travel, with mechanical advantage, of the lock ring 216 into the socket 251.

The securing mechanism further comprises a wedging mechanism for causing increased wedging of the lock ring 216 between the wear sleeve 208 and the shaft 204 in response to increased axial penetration of the lock ring 216 into the socket 251. In the example embodiment of FIG. 2, the wedging mechanism comprises inclined planar surfaces on the lock ring 216 and the wear sleeve 208 respectively, indicated in FIG. 2 as ramp surface 224 provided by the shaft 204, and coplanar tapered flat 303 provided by the radially inner surface of the lock ring 216. The construction of these features can best be understood with reference to FIGS. 3 and 4.

Figure 4:
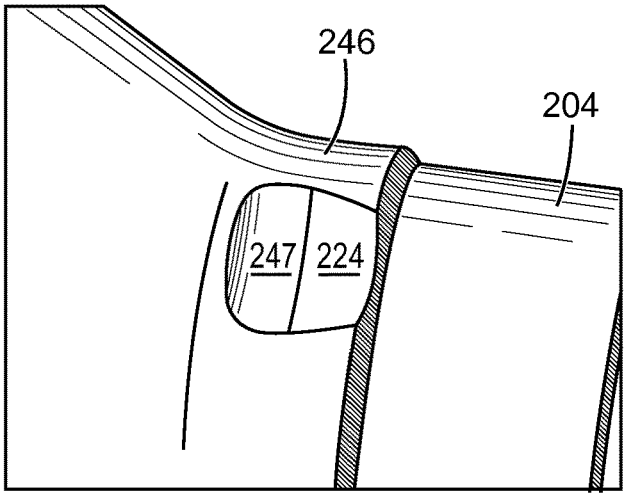
FIG. 4 depicts an isolated three-dimensional view of a part of a driveshaft for incorporation in a sealed rotary assembly consistent with the example embodiment of FIG. 3.

In FIG. 4, it can be seen that the shaft 204 provides a radially stepped shoulder 246 on its radially outer surface, such that the radial periphery of the shoulder 246 is generally circular cylindrical, having a constant diameter along its length. Material is removed from this circular cylindrical shoulder 246 along a plane which is inclined relative to the rotary axis of the shaft 204, to provide the flat ramp surface 224 progressively receding into the shoulder 246 with an increase in uphold axial movement, away from the wear sleeve 208. At an end of the ramp surface 224 furthest from the shoulder 246's radial step (and therefore furthest from the wear sleeve 208) is provided an axially extending landing 247 on which the lock ring 216 is receivable axially separated from the socket 251 during mounting or removal of the wear sleeve 208. The landing 247 may be a more or less flat surface lying in a plane approximately parallel to the rotary axis of the shaft 204. Note that, in this example embodiment, a pair of diametrically opposite ramp formations is provided on the shoulder 246 of the shaft 204, each comprising a ramp surface 224 and a landing 247.

Figure 5:
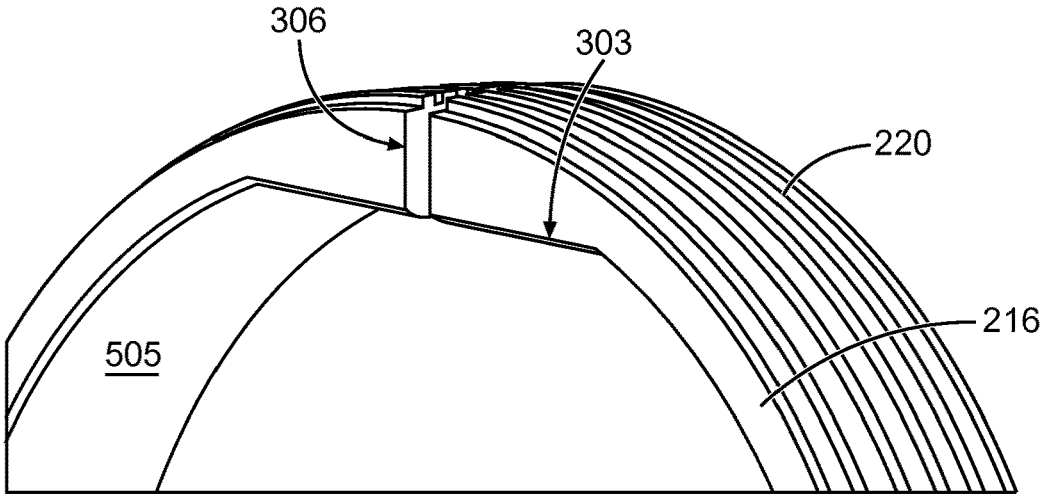
FIG. 5 depicts an isolated three-dimensional view of a part of a lock ring for incorporation in a sealed rotary assembly consistent with the example embodiment of FIG. 3, showing a non-circular rotational key formation defined on a radially inner surface of the lock ring.

The lock ring 216 is configured to have a radially inner periphery complementary to the radially outer periphery of the shoulder 246. As can be seen most clearly in FIGS. 5 and 6, the radially inner periphery of the lock ring 216 therefore comprises a circular cylindrical inner surface 505 (complementary to the circular cylindrical outer surface of the shoulder 246 outside of the ramp surfaces 224 and landings 247), interrupted at two diametrically opposite positions by the tapered flats 303 (complementary in shape and orientation to the ramp surfaces 224). When seen in axial end view (see FIG. 6) or in cross-sectional profile, the lock ring 216 has a non-circular radially inner periphery an outline, with the shoulder 246 of the shaft 204 having a complementary non-circular radially outer periphery, when viewed in cross-sectional outline. Non-circular of these outlines is in this example embodiment provided by the presence of the tapered flats 303, thereby serving as keying formations for rotationally keying together the shaft 204 and lock ring 216. Note that the view of FIG. 6 is an axial end view taken from the downhole side of the lock ring 216 in its orientation shown in FIGS. 2-5 allowing foreshortened view of the pair of diametrically opposed tapered flats 303.

Figure 6:
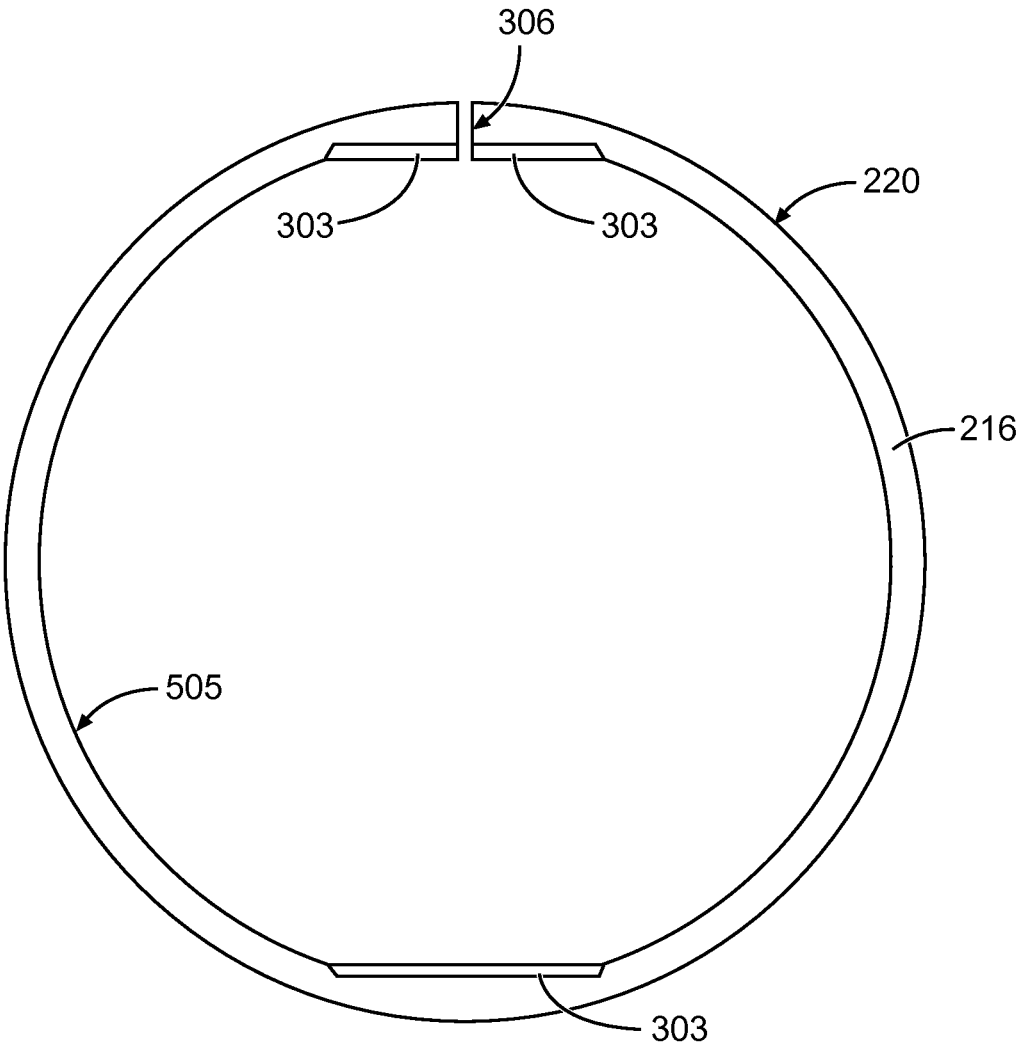
FIG. 6 depicts a schematic axial end view of the example lock ring of FIG. 5, showing a diametrically opposed pair of rotational keying formations for rotationally anchoring the lock ring on a driveshaft.

As can also be seen most clearly in FIG. 6, the lock ring 216 is a split ring, having a relatively small gap or split 306 extending axially through the lock ring 216, thereby providing it pair of closely spaced separated ends of the lock ring 216. Such configuration of the lock ring 216 as a split ring allows an operator to increase the separation between the adjacent ends of the lock ring 216, resiliently deforming the steel lock ring 216, and passing the expanded axial split 306 over the shaft 204, to allow removal and replacement of the lock ring 216 without removal of any other component of the steering assembly 150.

Figure 3:
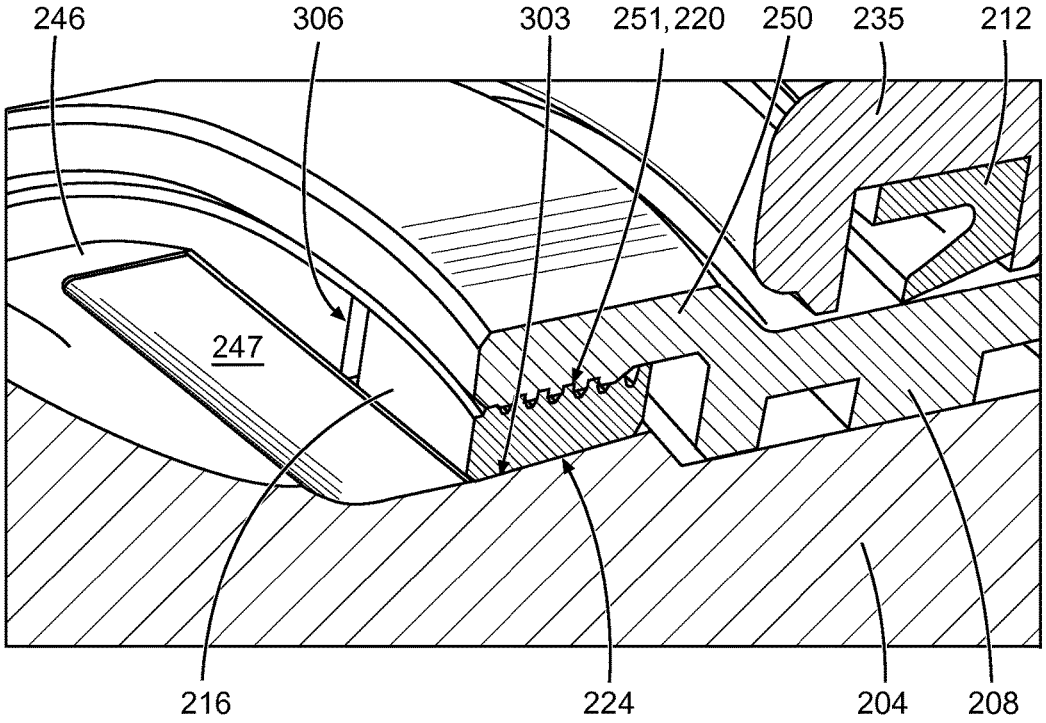
FIG. 3 depicts a partially sectioned schematic three-dimensional view of a securing mechanism forming part of a sealed rotary assembly similar or analogous to the example embodiment of FIG. 2, the securing mechanism including a screw-threaded lock ring located on a tapered seat provided by the driveshaft.

In operation, the shoulder formation 246 of the shaft 204, the lock ring 216, and the socket formation 251 of the lock ring 216 together provide a securing mechanism for securing together the wear sleeve 208 and the shaft 204 to substantially prevent relative rotational, radial, and axial movement. A method of securing the wear sleeve 208 to the shaft 204 can comprise first locating the lock ring 216 around the flat landings 247 of the shaft shoulder 246, e.g. by urging apart the split ends of the lock ring 216. In this example embodiment, the configuration of the shaft 204 and wear sleeve 208 causes resistance to axial movement of the wear sleeve 208 axially uphole (i.e., further into the shoulder 246) beyond the axial position shown schematically in, for example, FIG. 2. In some embodiments, limitation of axial uphole movement of the sleeve came to reach on the shaft 204 may be provided by abutment of the wear sleeve 208 against the annular step of the shoulder 246. As can be seen in FIGS. 2 and 3, the annular socket formation 250 in this position projects axially over the tapered flats 303, being radially spaced therefrom to define the axially open socket 251.

It will be seen that the landings 247 thus allow assembly of the securing mechanism by providing a staging area for the lock ring 216 prior to screwing engagement with the wear sleeve 208. Note that, even when the lock ring 216 is axially in register with the landings 247, rotation of the lock ring 216 relative to the shaft 204 is prevented by complementary mating reception of the non-circular shoulder 246 co-axially in the lock ring 216. Face-to-face radial contact between the tapered flats 303 and the oppositely outwardly facing, coplanar ramp surfaces 224 thus keying the lock ring 216 to the shaft 204, preventing relative rotation between them.

The wear sleeve 208 is thereafter rotated by an operator (e.g., using a working tool or wrench having dogs received spigot-socket fashion in complementary mating torqueing sockets in a radially outer periphery of a ring of the socket formation) to cause the socket formation 250 of the wear sleeve 208 to be screwed on to the rotationally stationary lock ring 216 by operation of the complementary screw threads 220. As the wear sleeve 208 is further torqued up against the lock ring 216, the lock ring 216 is drawn further into the socket 251, increasing axial penetration of the lock ring 216 into the socket 251. The tapered flats 303 of the lock ring 216 are consequentially wedged further up the ramp surfaces 224, causing the lock ring 216 to be wedged further between the shaft 204 and the wear sleeve 208.

Note that the ramp surfaces 224 cooperate with the tapered flats 303 to urge the corresponding diametrically opposed portions of the lock ring 216 further apart, but that this radially outer urging is resisted by the annular socket formation 250, which has a circular cylindrical radially inner periphery. The resultant wedging action of the lock ring 216 causes the exertion of wedging forces by the lock ring 216 on the shaft 204 and the socket formation 250 of the wear sleeve 208 respectively. At the interface between the lock ring 216 in the shaft 204, these which influences are perpendicular to the ramp surface 224, thus having significant radial components, causing corresponding frictional resistance to relative movement of the surfaces.

The wedging in place of the tapered flats 303 against the shaft eliminates any clearance between the lock ring 216 and the shaft 204. Rotation of the lock ring 216 on the shaft 204 is prevented by the complementary non-circular keying formation is provided by the tapered flats 303 and the ramp surfaces 224, as described, while rotation of the wear sleeve 208 relative to the shaft 204 is prevented by the cooperating screw threads 220. In this regard, note that the screw threads 220 are oriented oppositely to the rotational direction of the shaft 204, in use, so that rotational inertia of the wear sleeve 208 during driven rotation of the shaft 204 tends, if anything, to further tighten the screw-thread connection between the wear sleeve 208 and the lock ring 216. Axial movement of the wear sleeve 208 relative to the lock ring 216 is prevented by the screw-threaded connection, while axial movement of the lock ring 216 on the shaft 204 is prevented by its being wedged in place within the socket 251, as described. Note that relative movement of the wear sleeve 208 uphole (i.e., further into the shoulder 246) is in this example embodiment prevented by positive obstruction of the wear sleeve 208 on stopping formations provided by the shaft 204, e.g. by abutment against the radial step of the shoulder 246. The wedging action of the lock ring 216 further ensures that the wear sleeve 208 remains co-axially centered on the shaft 204 and prevents radial movement of the wear sleeve 208 relative to the shaft 204.

It is a benefit of the example rotary assembly of the described steering assembly 150, and of the described securing mechanism, that it provides for significant improvements in effectiveness and reliability over existing locking mechanisms that comprise a threaded ring with a key that is receivable in a keyway on the shaft. The provision of the keyway on the shaft, for example, tends to create stress concentrations that can promote stress fatigue and cause reductions in product lifetime. The described securing mechanism, in contrast, provides for secure locking of the wear sleeve 208 onto the shaft, without providing significant stress risers in the torque-transmitting drive shaft 204. Note that, although the flats that define the ramp surfaces 224 do cause increased stress concentrations when compared to a circular cylindrical shaft, these stress concentrations and concomitant fatigue are much lower than is the case for the aforementioned keyway configuration.

The example securing mechanism therefore provides for superior reliability of a rotary seal life downhole. Increased reliability of such rotary seals is translated, in operation, to improved tool run times. Increased structural integrity of the example securing mechanism, when compared to the above-mentioned existing techniques, moreover now for use of rotary assemblies incorporating a wear sleeve 208 thus secured in downhole environments more hostile than those at which the discussed existing seal assembly can be deployed.

Note that various modifications may be made the above-referenced described example securing mechanism, without departing from the scope of the disclosure. A non-exhaustive selection of such possible modifications will now be described briefly. In another example embodiment, tapering formations or wedging formations to cause radial wedging of the lock ring 216 in response to axial penetration into the socket 251 may be provided at least in part by tapered screw threads on the lock ring 216 and the wear sleeve 208 respectively. The screw thread 220 on the radially periphery of the socket formation 250 can thus be generally frusto-conical, progressively increasing in diameter with an increase axial position into the socket 251.

The shaft 204 and wear sleeve 208 may in such embodiments have regular flat surfaces instead of the tapered surfaces provided by the tapered flats 303 and ramp surfaces 224. These non-tapering surfaces would thus lie in respective diametrically opposed planes that are parallel to and radially spaced from the rotary axis of the shaft 204.

The mechanics of rotational, axial, and radial anchoring of the wear sleeve 208 to the shaft 204 via the lock ring 216. Is similar or analogous to that described above with reference to FIGS. 2-6. The coplanar, engaged flat surfaces present rotational movement, the tapered threads prevent axial movement, and wedging action resulting from the tapered threads prevents radial movement and keeps the wear sleeve 208 co-axial with the shaft 204.

Figure 7:
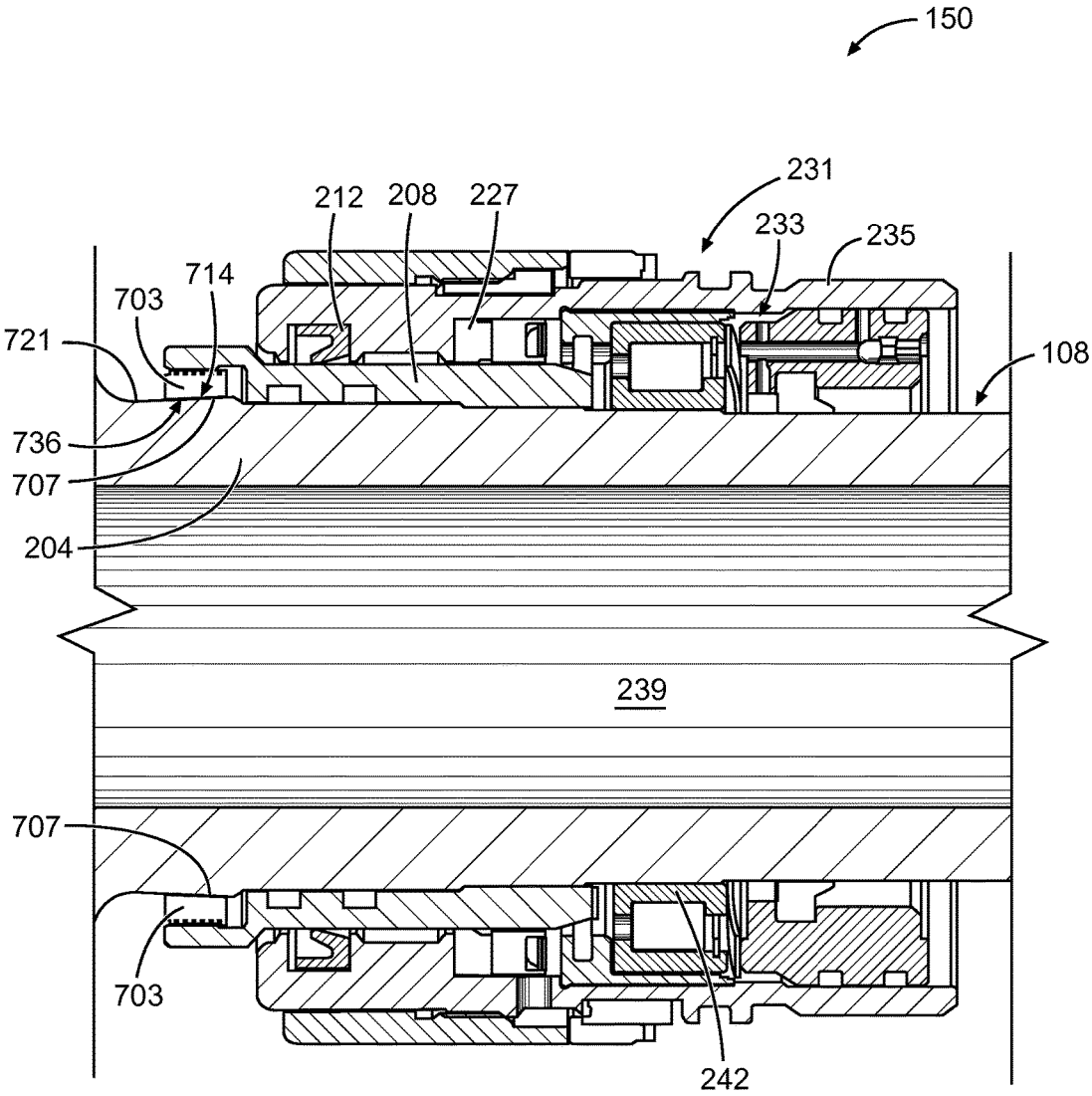
FIG. 7 depicts a schematic axial section of a drill string steering tool that comprises a sealed rotary assembly according to another example embodiment.
Figure 8:
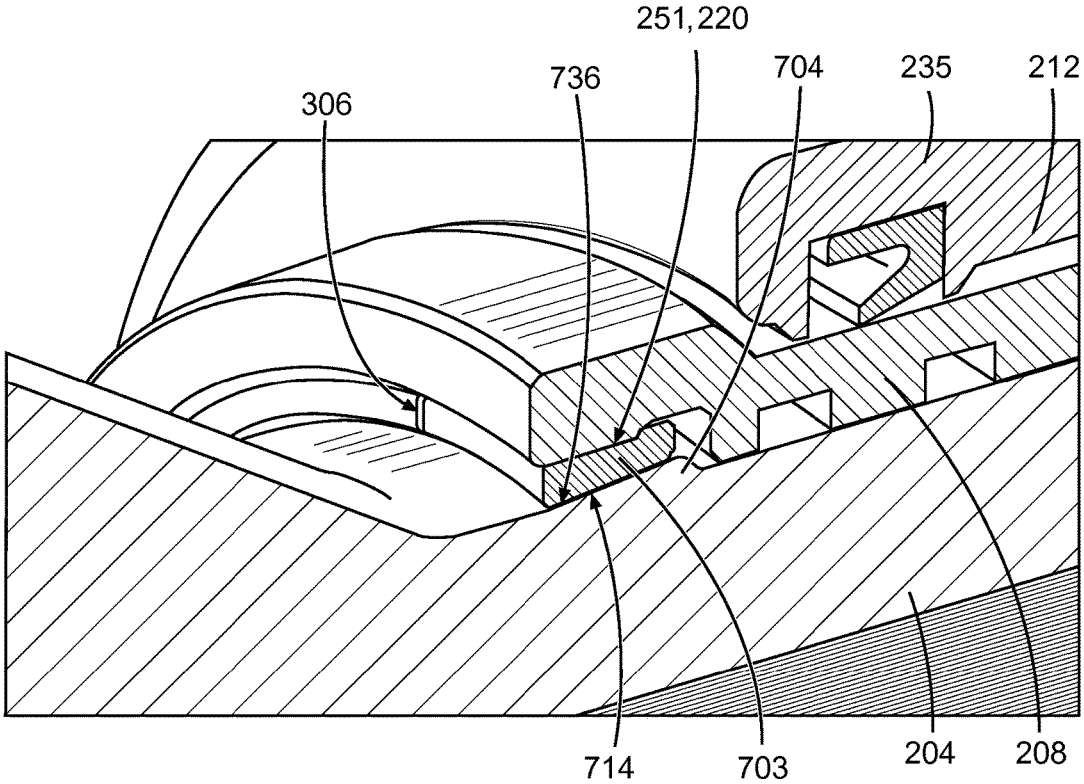
FIG. 8 is a partially sectioned three-dimensional view of a securing mechanism forming part of a well tool consistent with the example embodiment of FIG. 7, the securing mechanism providing for axial, radial, and rotational anchoring of a wear sleeve to a driven shaft of the well tool.

Another example embodiment of a wear sleeve securing mechanism consistent with the disclosure is illustrated schematically in FIGS. 7 and 8. A steering assembly in accordance with the example embodiment of FIG. 7 is configured for removable and replaceable securing or knocking of the wear sleeve 208 using techniques and or analogous to that described before. A radially stepped shoulder of the shaft 204 in the FIG. 7 embodiment, however, provides a circumferentially continuous tapered ramp surface 714 on its radially outer periphery, thus being frustoconical in shape. In other words, the cross-sectional outline of the ramp surface 714 is circular at each point along its axial length, but increases progressively in diameter with an increasing axial position downhole (i.e., towards the wear sleeve 208). The lock ring 703 defines a matching conical taper on its radially inner periphery, which thus provides frustoconical incline 736 for matching cooperation with the ramp surface 714. The shoulder again defines a landing 721 that provides an axial staging area in which the lock ring 703 can be located before the wear sleeve 208 is screwed on to the lock ring 703.

When the wear sleeve 208 is, in operation, screwed onto the cylindrical screw thread 220 of the wear sleeve 208, the lock ring 703 is pulled axially up the ramp surface 714, thus urging radial expansion of the lock ring 703. Because the lock ring 703 is, however, radially held captive by the circular cylindrical screw thread 220 of the wear sleeve 208, the lock ring 703 is progressively which into contact with the wear sleeve 208 and the shaft 204 in response to screwing tightening by application of tightening torque to the wear sleeve 208. Transverse wedging forces thus elicited by wedging interface of the lock ring with the wear sleeve 208 and the shaft 204 serve in this example embodiment to rotationally key the lock ring 703 to the shaft 204. Note that, in this example embodiment, there is no positive or mechanical rotational anchoring of the lock ring 703 to the shaft 204. Instead, the lock ring 703 is rotationally secured to the shaft 204 because of tangentially acting friction caused by the wedging of the lock ring 703.

The screw thread 220 is oriented such as to oppose the direction of rotary frictional forces exerted on the wear sleeve 208 by the barrier seal 212 and the main seal 227. A minimum value for tightening torque which is to be applied to the wear sleeve 208 is calculated to be large enough to generate sufficient frictional force on the ramp surface 714 to overcome a breakout torque from the barrier seal 212 and the main seal 227, thereby to prevent rotational movement of the wear sleeve 208 relative to the shaft 204. By utilizing a screw thread 220 oriented such that it would tend to torque up with the seal drag, it is ensured that the wear sleeve 208 does not loosen downhole.

In the embodiment of FIGS. 7 and 8, axial movement is again prevented by the screw threads 220 and the tapered surfaces, while relative radial movement is again prevented by wedging action of the lock ring 703.

It will thus be seen that one aspect of the above-described example embodiments tool assembly comprising:

- a shaft extending longitudinally along a rotary axis;
- a protective sleeve located co-axially on the shaft to cover a radially outer surface of the shaft along an axially extending portion of the shaft, the protective sleeve defining a wear surface configured for circumferential sealing engagement with a rotary seal through which the protective sleeve is to extend co-axially and relative to which the protective sleeve is rotatable about the rotary axis;
- a socket formation provided by the protective sleeve and defining an annular socket that is co-axial with the shaft;
- a lock ring that is located co-axially on the shaft and that is engageable with the protective sleeve by relative axial movement thereof into the annular socket; and
- a wedging mechanism configured to cause wedging of the lock ring between the protective sleeve and the shaft in response to axial penetration of the lock ring into the annular socket, thereby to secure together the protective sleeve to the shaft.

The tool assembly may further comprise a tightening mechanism configured to translate an operator-applied tightening torque with mechanical advantage to increased axial penetration of the lock ring into the annular socket, to effect corresponding increased radial wedging forces exerted by the lock ring. The tightening mechanism may in some embodiments comprise complementary screw threads co-axial with the rotary axis and configured for screwing engagement to advance the lock ring into the annular socket in response to relative rotation of the screw threads in a tightening direction. The tightening direction may be oriented such that rotational inertia caused by operative relative rotation of the assembly components tends to act in tightening direction.

In some embodiments, the complementary screw threads may be tapered relative to the rotary axis, decreasing in diameter with an increase in axial position corresponding to relative movement of the locking ring into the annular socket, so that the screw threads provide at least part of the wedging mechanism. Such tapered screw-threads may thus serve both as wedging formations and comprise part of the tightening mechanism.

A securing mechanism forming part of the tool assembly may in some embodiments comprise a keying mechanism configured to rotationally key the lock ring to the shaft by positive interference (as contrasted to frictional interaction) between the lock ring and the shaft. The keying mechanism may comprise:

a seat formation forming part of the shaft and defining a radially outer seating surface for the lock ring, the seating surface having a non-circular cross-sectional outline; and a radially inner surface of the lock ring that is configured for reception on the seat formation of the shaft and that has a non-circular cross-sectional outline complementary to that of the seat formation. The cross-sectional outline of the shaft may be shaped such as to define no acute internal angles. In some embodiments, the cross-sectional outline of the shaft may define a circle truncated along one or more of its chords to define one or more flat surfaces in cross-section.

The wedging mechanism may comprise complementary tapered formations configured for wedging engagement to cause radial wedging forces that urge apart the shaft and the socket formation of the protective sleeve and that are variable in magnitude corresponding to variation of axial penetration of the lock ring into the annular socket. The tapered formations may comprise:

a ramp surface defined by a radially outer periphery of the shaft and being radially tapered relative to the rotary axis; and a complementary taper surface defined by a radially inner periphery of the lock ring.

The ramp surface and the complementary taper surface may each be a planar surface lying in an inclined plane relative to the rotary axis. In such cases, the shaft may define at least one pair of diametrically opposed ramp surfaces configured for cooperation with a corresponding pair of diametrically opposed taper surfaces on the radially inner periphery of the lock ring. In other embodiments, each of the ramp surface and the taper surface may be at least partially frustoconical, defining an at least partially circumferential compound curvature. In some embodiments, the frustoconical taper surface may extend circumferentially for substantially the entirety of the circumference of the shaft and/or the lock ring.

The lock ring may be a split annular element, having opposite circumferential ends separated by a gap extending axially through the lock ring, to allow transverse removal of the lock ring by forced expansion of the gap and passage thereof over the shaft.

The tool assembly may further comprise:

a non-rotary housing in which the shaft is rotatably received and in which the shaft is radially held captive; and the rotary seal held by the housing and secured against rotation relative to the housing, wherein the shaft extends co-axially through the rotary seal such that a radially inner periphery of the rotary seal is in circumferentially extending sealing contact with the wear surface of the protective sleeve. Note, again, that the housing may in other embodiments be a rotary element rotatable relative to a non-rotating shaft.

The tool assembly may in some embodiments comprise a well tool. In some such embodiments, the shaft may comprise a tubular member configured for in-line incorporation in a drill string to transmit torque and rotation between a pair of drill string components connected to opposite ends of the shaft. In some other embodiments, the housing or housing sleeve may be drivingly connected to a composite tubular wall of the drill string for torque transmission.

A further aspect of the disclosure comprises a lock ring for incorporation in a well tool assembly that comprises relatively rotating co-axial elements, the well tool assembly in some embodiments comprising a tubular shaft and a protective sleeve mounted co-axially on the shaft. The lock ring may comprise:

a generally annular ring body that is configured for co-axial mounting on the shaft and for axial reception in a socket cavity between the protective sleeve and the shaft;

a screw-thread provided on a radial periphery of the ring body, the screw-thread being configured for screwing engagement with a complementary screw-thread to cause axial advance of the lock ring into the socket cavity; and a wedging formation defined by the ring body and configured for wedging the lock ring between the protective sleeve and the shaft in response to axial advance of the lock ring into the socket cavity.

The wedging formation may comprise one or more flat taper surfaces defined by a radially inner periphery of the ring body, each taper surface lying in an inclined plane relative to the shaft and configured for wedging cooperation with a complementary ramp surface on a radially outer periphery of the shaft to urge the wedging formation radially outwards in response to axial advance of the lock ring into the socket cavity. In some embodiments, the one or more taper surfaces may comprise a plurality of taper surfaces that are arranged on the radially inner periphery of the ring body to be rotationally symmetrical about a longitudinal axis of the ring body.

Instead, or in addition, the wedging formation may comprise a frustoconical wedging surface defined by a radially inner periphery of the ring body, the frustoconical wedging surface being configured for wedging interaction with a complementary frustoconical ramp surface on the shaft, to urge the ring body radially outwards in response to axial advance thereof further into the socket cavity.

In some embodiments, the wedging formation or mechanism may be provided at least in part by the screw-thread, the screw-thread being tapered and varying in diameter at different axial positions. Various aspects relevant to lock rings, as described above with reference to tool assemblies and methods for securing a rotary assembly wear sleeve, may apply mutatis mutandis to some embodiments of the lock ring.

A further aspect of the disclosure comprises a method:

locating a protective sleeve co-axially on a shaft of a tool assembly, to cover a radially outer surface of the shaft along an axially extending portion of the shaft, the protective sleeve defining a wear surface configured for circumferential sealing engagement with a rotary seal through which the protective sleeve is to extend such as to allow sealing relative rotation between the protective sleeve and the rotary seal;

locating a lock ring co-axially on the shaft;

receiving the lock ring in a socket defined between the protective sleeve and the shaft, causing screwing engagement between cooperating screw-threads on the lock ring and the protective sleeve, respectively; and applying tightening torque to the cooperating screw threads, to increase axial penetration of the lock ring into the socket and cause wedging of the lock ring between the protective sleeve and the shaft, thereby to secure the protective sleeve to the shaft to prevent relative movement between them.

The lock ring may have a non-circular radially inner periphery that cooperates with a complementary radially outer periphery of the shaft to rotationally anchor the lock ring to the shaft, the applying of the tightening torque comprising operator application of the torque to the protective sleeve. Various aspects of the disclosure discussed above with reference to different embodiments of a tool assembly and/or a lock ring may apply also to a method of securing a rotary assembly wear sleeve in accordance with some embodiments of the disclosure.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A tool assembly comprising:

a shaft extending longitudinally along a rotary axis;

a protective sleeve located co-axially on the shaft to cover a radially outer surface of the shaft along an axially extending portion of the shaft, the protective sleeve defining a wear surface configured for circumferential sealing engagement with a rotary seal through which the protective sleeve is to extend co-axially and relative to which the protective sleeve is rotatable about the rotary axis;

a socket formation provided by the protective sleeve and defining an annular socket that is co-axial with the shaft;

a lock ring that is located co-axially on the shaft and that is engageable with the protective sleeve by relative axial movement thereof into the annular socket;

a wedging mechanism configured to cause wedging of the lock ring between the protective sleeve and the shaft in response to axial penetration of the lock ring into the annular socket, thereby to secure together the protective sleeve to the shaft; and a keying mechanism configured to rotationally key the lock ring to the shaft, the keying mechanism comprising:

a seat formation forming part of the shaft and defining a radially outer seating surface for the lock ring, the seating surface having a non-circular cross-sectional outline; and a radially inner surface of the lock ring that is configured for reception on the seat formation of the shaft and that has a non-circular cross-sectional outline complementary to that of the seat formation.

2. The tool assembly of claim 1, further comprising a tightening mechanism configured to translate an operator-applied tightening torque with mechanical advantage to increased axial penetration of the lock ring into the annular socket, to effect corresponding increased radial wedging forces exerted by the lock ring.

3. The tool assembly of claim 2, wherein the tightening mechanism comprises complementary screw threads co-axial with the rotary axis and configured for screwing engagement to advance the lock ring into the annular socket in response to relative rotation of the screw threads in a tightening direction.

4. The tool assembly of claim 3, wherein the complementary screw threads are tapered relative to the rotary axis, decreasing in diameter in an axial direction corresponding to relative movement of the locking ring into the annular socket, so that the screw threads provide at least part of the wedging mechanism.

5. The tool assembly of claim 1, wherein the wedging mechanism comprises complementary tapered formations configured for wedging engagement to cause radial wedging forces that urge apart the shaft and the socket formation of the protective sleeve, and that are variable in magnitude corresponding to variation of axial penetration of the lock ring into the annular socket.

6. The tool assembly of claim 5, wherein the tapered formations comprise:

a ramp surface defined by a radially outer periphery of the shaft and being radially tapered relative to the rotary axis; and a complementary taper surface defined by a radially inner periphery of the lock ring.

7. The tool assembly of claim 6, wherein the ramp surface and the complementary taper surface are each a planar surface lying in an inclined plane relative to the rotary axis.

8. The tool assembly of claim 7, wherein the shaft defines at least one pair of diametrically opposed ramp surfaces configured for cooperation with a corresponding pair of diametrically opposed taper surfaces on the radially inner periphery of the lock ring.

9. The tool assembly of claim 6, wherein each of the ramp surfaces and the taper surfaces is at least partially frusto-conical, defining an at least partially circumferential compound curvature.

10. The tool assembly of claim 1, wherein the lock ring is a split annular element, having opposite circumferential ends separated by a gap extending axially through the lock ring, to allow transverse removal of the lock ring by forced expansion of the gap and passage thereof over the shaft.

11. The tool assembly of claim 1, further comprising:

a non-rotary housing in which the shaft is rotatably received and in which the shaft is radially held captive; and the rotary seal held by the housing and secured against rotation relative to the housing, wherein the shaft extends co-axially through the rotary seal such that a radially inner periphery of the rotary seal is in circumferentially extending sealing contact with the wear surface of the protective sleeve.

12. The tool assembly of claim 11, wherein the tool assembly comprises a well tool, the shaft comprising a tubular member configured for in-line incorporation in a drill string to transmit torque and rotation between a pair of drill string components connected to opposite ends of the shaft.

13. A lock ring for incorporation in a well tool assembly that comprises a tubular shaft and a protective sleeve mounted co-axially on the shaft, the lock ring comprising:

a generally annular ring body that is configured for co-axial mounting on the shaft and for axial reception in a socket cavity between the protective sleeve and the shaft;

a screw-thread provided on a radial periphery of the ring body, the screw-thread being configured for screwing engagement with a complementary screw-thread to cause axial advance of the lock ring into the socket cavity;

a wedging formation defined by the ring body and configured for wedging the lock ring between the protective sleeve and the shaft in response to axial advance of the lock ring into the socket cavity; and a keying mechanism configured to rotationally key the lock ring to the shaft, the keying mechanism comprising:

a seat formation forming part of the shaft and defining a radially outer seating surface for the lock ring, the seating surface having a non-circular cross-sectional outline; and a radially inner surface of the lock ring that is configured for reception on the seat formation of the shaft and that has a non-circular cross-sectional outline complementary to that of the seat formation.

14. The lock ring of claim 13, wherein the wedging formation comprises one or more flat taper surfaces defined by a radially inner periphery of the ring body, each taper surface lying in an inclined plane relative to the shaft and configured for wedging cooperation with a complementary ramp surface on a radially outer periphery of the shaft to urge the wedging formation radially outwards in response to axial advance of the lock ring into the socket cavity.

15. The lock ring of claim 14, wherein the one or more flat taper surfaces comprises a plurality of taper surfaces that are arranged on the radially inner periphery of the ring body to be rotationally symmetrical about a longitudinal axis of the ring body.

16. The lock ring of claim 15, wherein the wedging formation comprises a frustoconical wedging surface defined by a radially inner periphery of the ring body, the frustoconical wedging surface being configured for wedging interaction with a complementary frustoconical ramp surface on the shaft, to urge the ring body radially outwards in response to axial advance thereof further into the socket cavity.

17. The lock ring of claim 15, wherein the wedging formation is provided at least in part by the screw-thread, the screw-thread being tapered and varying in diameter at different axial positions.

18. A method comprising:

locating a protective sleeve co-axially on a shaft of a tool assembly, to cover a radially outer surface of the shaft along an axially extending portion of the shaft, the protective sleeve defining a wear surface configured for circumferential sealing engagement with a rotary seal through which the protective sleeve is to extend such as to allow sealing relative rotation between the protective sleeve and the rotary seal;

locating a lock ring co-axially on the shaft;

receiving the lock ring in a socket defined between the protective sleeve and the shaft, causing screwing engagement between cooperating screw-threads on the lock ring and the protective sleeve, respectively; and applying tightening torque to the cooperating screw threads, to increase axial penetration of the lock ring into the socket and cause wedging of the lock ring between the protective sleeve and the shaft, thereby securing the protective sleeve to the shaft to prevent relative movement between them, wherein the lock ring has a non-circular radially inner periphery that cooperates with a complementary radially outer periphery of the shaft to rotationally anchor the lock ring to the shaft, the applying of the tightening torque comprising operator application of the torque to the protective sleeve.

* * * * *